US010707558B2

(12) United States Patent
Hu et al.

(10) Patent No.: US 10,707,558 B2
(45) Date of Patent: Jul. 7, 2020

(54) ELECTRONIC DEVICE ANTENNA WITH EMBEDDED PARASITIC ARM

(71) Applicant: Apple Inc., Cupertino, CA (US)

(72) Inventors: Hongfei Hu, Cupertino, CA (US); Benjamin Hane Bustle, Cupertino, CA (US); Enrique Ayala Vazquez, Watsonville, CA (US); Nanbo Jin, San Jose, CA (US); Miguel Christophy, San Francisco, CA (US); Erdinc Irci, Sunnyvale, CA (US); Salih Yarga, Sunnyvale, CA (US); Erica Tong, Pacifica, CA (US); Anand Lakshmanan, San Jose, CA (US); Mattia Pascolini, San Francisco, CA (US); Tyler Cater, San Jose, CA (US); Christopher T. Cheng, Sunnyvale, CA (US)

(73) Assignee: Apple Inc., Cupertino, CA (US)

( * ) Notice: Subject to any disclaimer, the term of this patent is extended or adjusted under 35 U.S.C. 154(b) by 136 days.

(21) Appl. No.: 15/837,873

(22) Filed: Dec. 11, 2017

(65) Prior Publication Data

US 2018/0115053 A1 Apr. 26, 2018

Related U.S. Application Data

(63) Continuation of application No. 14/829,008, filed on Aug. 18, 2015, now Pat. No. 9,876,272.

(51) Int. Cl.

| | |
|---|---|
| ***H01Q 1/24*** | (2006.01) |
| ***H01Q 13/10*** | (2006.01) |
| ***H01Q 5/357*** | (2015.01) |

(52) U.S. Cl.
CPC ..... *H01Q 1/243* (2013.01); *H01Q 5/357* (2015.01); *H01Q 13/103* (2013.01)

(58) Field of Classification Search
CPC ..... H01Q 13/10; H01Q 13/103; H01Q 1/24; H01Q 1/243; H01Q 1/38; H01Q 5/357;
(Continued)

(56) References Cited

U.S. PATENT DOCUMENTS 6,473,042 B1 * 10/2002 Fang ..... G06F 1/1616 343/700 MS
7,898,485 B2 * 3/2011 Schlub ..... H01Q 1/243 343/702

(Continued)

FOREIGN PATENT DOCUMENTS

CN 102736686 A 10/2012
CN 103199335 A 7/2013

(Continued)

*Primary Examiner* — Tho G Phan
(74) *Attorney, Agent, or Firm* — Treyz Law Group, P.C.; G. Victor Treyz; Michael H. Lyons

(57) ABSTRACT

An electronic device may have wireless circuitry with antennas. An antenna resonating element arm for an antenna may be formed from peripheral conductive structures running along the edges of a device housing. The peripheral conductive structures may form housing sidewalls. A slot may be machined into a metal housing that separates the housing sidewalls from a planar rear housing portion that forms a ground for an antenna. The slot may be filled with plastic filler. A parasitic antenna resonating element arm that supports an antenna resonance at high band frequencies may be embedded within the plastic filler. The parasitic antenna resonating element may be formed from a portion of the planar rear housing portion.

22 Claims, 18 Drawing Sheets

(58) Field of Classification Search
CPC . H01Q 19/10; F04C 18/0215; F04C 2240/80; F04C 27/008; F04C 29/026; F04C 29/028; F04C 29/12
See application file for complete search history.

(56) References Cited

U.S. PATENT DOCUMENTS

| | | | | |
|---|---|---|---|---|
| 8,466,839 | B2 | 6/2013 | Schlub et al. | |
| 9,203,139 | B2 | 12/2015 | Zhu et al. | |
| 9,236,659 | B2 | 1/2016 | Vazquez et al. | |
| 9,337,528 | B2 * | 5/2016 | Hammond | H01Q 1/243 |
| 9,496,608 | B2 | 11/2016 | Jiang et al. | |
| 9,768,491 | B2 | 9/2017 | Jin et al. | |
| 2011/0254741 | A1 | 10/2011 | Ishimiya | |
| 2012/0112970 | A1 * | 5/2012 | Caballero | H01Q 1/243 343/702 |
| 2013/0194139 | A1 | 8/2013 | Nickel et al. | |
| 2014/0009342 | A1 | 1/2014 | Wei | |
| 2014/0091974 | A1 | 4/2014 | Desclos et al. | |
| 2014/0139379 | A1 | 5/2014 | Bolin et al. | |
| 2014/0266922 | A1 | 9/2014 | Jin et al. | |
| 2017/0033460 | A1 | 2/2017 | Ayala Vazquez et al. | |
| 2017/0040668 | A1 | 2/2017 | Ayala Vazquez et al. | |

FOREIGN PATENT DOCUMENTS

| | | | |
|---|---|---|---|
| CN | 104064865 | A | 9/2014 |
| CN | 104701618 | A | 6/2015 |

* cited by examiner

ELECTRONIC DEVICE ANTENNA WITH EMBEDDED PARASITIC ARM

This application is a continuation of U.S. patent application Ser. No. 14/829,008, filed Aug. 18, 2015, which is hereby incorporated by reference herein in its entirety. This application claims the benefit of and claims priority to U.S. patent application Ser. No. 14/829,008, filed Aug. 18, 2015.

BACKGROUND

This relates generally to electronic devices and, more particularly, to electronic devices with wireless communications circuitry.

Electronic devices often include wireless circuitry with antennas. For example, cellular telephones, computers, and other devices often contain antennas for supporting wireless communications.

It can be challenging to form electronic device antenna structures with desired attributes. In some wireless devices, the presence of conductive structures such as conductive housing structures can influence antenna performance. Antenna performance may not be satisfactory if the housing structures are not configured properly and interfere with antenna operation. Device size can also affect performance. It can be difficult to achieve desired performance levels in a compact device, particularly when the compact device has conductive housing structures.

It would therefore be desirable to be able to provide improved wireless circuitry for electronic devices such as electronic devices that include conductive housing structures.

SUMMARY

An electronic device may have wireless circuitry with antennas. The device may have a housing such as a rectangular housing with four edges. The housing may have conductive structures such as peripheral conductive structures that run along the edges of the housing. The peripheral conductive structures may form housing sidewalls.

Antennas may be formed using slots in the housing. A slot may run along an edge of a device between a sidewall portion of the housing and a rear wall portion of the housing. The rear wall portion may form part of an antenna ground for an antenna. The sidewall portion may be used in forming an antenna resonating element arm for the antenna. The antenna formed from the antenna ground and antenna resonating element arm may have an antenna feed with a first feed terminal coupled to the sidewall portion and a second feed terminal coupled to the rear wall portion.

The slot may be filled with a dielectric material such as plastic. A parasitic antenna resonating element arm may be embedded within the plastic and may extend along the slot. The parasitic antenna resonating element arm may be formed from a portion of the rear housing wall that extends from the rear wall into the slot and then runs along the length of the slot between the sidewall portion and the rear wall portion.

The embedded parasitic antenna resonating element arm may be formed by milling operations to form the slot in the housing, injection molding operations to place plastic into the slot, milling operations to free the edges of the parasitic arm from the housing while the arm is supported by the injected molded plastic, and additional injection molding operations to embed the arm into the plastic in the slot. A milling operation may be performed after the arm has been embedded in the plastic to create a curved sidewall profile or other desired profile in the sidewall portions of the housing.

DETAILED DESCRIPTION

Figure 1:
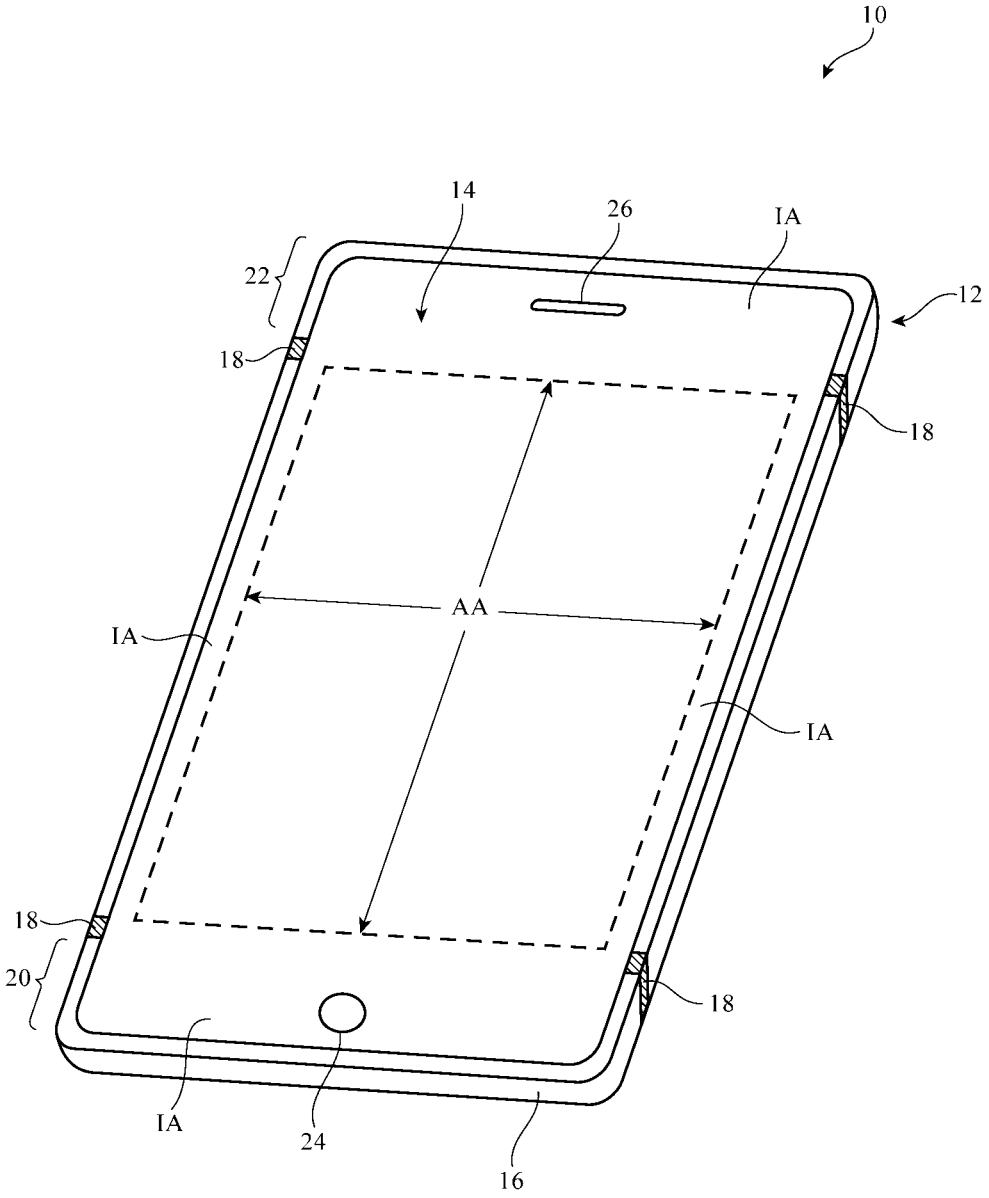
FIG. 1 is a perspective view of an illustrative electronic device in accordance with an embodiment.

Electronic devices such as electronic device 10 of FIG. 1 may be provided with wireless communications circuitry. The wireless communications circuitry may be used to support wireless communications in multiple wireless communications bands.

The wireless communications circuitry may include one more antennas. The antennas of the wireless communications circuitry can include loop antennas, inverted-F antennas, strip antennas, planar inverted-F antennas, slot antennas, hybrid antennas that include antenna structures of more than one type, or other suitable antennas. Conductive structures for the antennas may, if desired, be formed from conductive electronic device structures.

The conductive electronic device structures may include conductive housing structures. The housing structures may include peripheral structures such as peripheral conductive structures that run around the periphery of an electronic device. The peripheral conductive structure may serve as a bezel for a planar structure such as a display, may serve as sidewall structures for a device housing, may have portions that extend upwards from an integral planar rear housing (e.g., to form vertical planar sidewalls or curved sidewalls), and/or may form other housing structures.

Gaps may be formed in the peripheral conductive structures that divide the peripheral conductive structures into peripheral segments. One or more of the segments may be used in forming one or more antennas for electronic device 10. Antennas may also be formed using an antenna ground plane formed from conductive housing structures such as metal housing midplate structures and other internal device structures. Rear housing wall structures may be used in forming antenna structures such as an antenna ground.

Electronic device 10 may be a portable electronic device or other suitable electronic device. For example, electronic device 10 may be a laptop computer, a tablet computer, a somewhat smaller device such as a wrist-watch device, pendant device, headphone device, earpiece device, or other wearable or miniature device, a handheld device such as a cellular telephone, a media player, or other small portable device. Device 10 may also be a set-top box, a desktop computer, a display into which a computer or other processing circuitry has been integrated, a display without an integrated computer, or other suitable electronic equipment.

Device 10 may include a housing such as housing 12. Housing 12, which may sometimes be referred to as a case, may be formed of plastic, glass, ceramics, fiber composites, metal (e.g., stainless steel, aluminum, etc.), other suitable materials, or a combination of these materials. In some situations, parts of housing 12 may be formed from dielectric or other low-conductivity material. In other situations, housing 12 or at least some of the structures that make up housing 12 may be formed from metal elements.

Device 10 may, if desired, have a display such as display 14. Display 14 may be mounted on the front face of device 10. Display 14 may be a touch screen that incorporates capacitive touch electrodes or may be insensitive to touch. The rear face of housing 12 (i.e., the face of device 10 opposing the front face of device 10) may have a planar housing wall. The rear housing wall may be have slots that pass entirely through the rear housing wall and that therefore separate housing wall portions (and/or sidewall portions) of housing 12 from each other. Housing 12 (e.g., the rear housing wall, sidewalls, etc.) may also have shallow grooves that do not pass entirely through housing 12. The slots and grooves may be filled with plastic or other dielectric. If desired, portions of housing 12 that have been separated from each other (e.g., by a through slot) may be joined by internal conductive structures (e.g., sheet metal or other metal members that bridge the slot).

Display 14 may include pixels formed from light-emitting diodes (LEDs), organic LEDs (OLEDs), plasma cells, electrowetting pixels, electrophoretic pixels, liquid crystal display (LCD) components, or other suitable pixel structures. A display cover layer such as a layer of clear glass or plastic may cover the surface of display 14 or the outermost layer of display 14 may be formed from a color filter layer, thin-film transistor layer, or other display layer. Buttons such as button 24 may pass through openings in the cover layer. The cover layer may also have other openings such as an opening for speaker port 26.

Housing 12 may include peripheral housing structures such as structures 16. Structures 16 may run around the periphery of device 10 and display 14. In configurations in which device 10 and display 14 have a rectangular shape with four edges, structures 16 may be implemented using peripheral housing structures that have a rectangular ring shape with four corresponding edges (as an example). Peripheral structures 16 or part of peripheral structures 16 may serve as a bezel for display 14 (e.g., a cosmetic trim that surrounds all four sides of display 14 and/or that helps hold display 14 to device 10). Peripheral structures 16 may also, if desired, form sidewall structures for device 10 (e.g., by forming a metal band with vertical sidewalls, curved sidewalls, etc.).

Peripheral housing structures 16 may be formed of a conductive material such as metal and may therefore sometimes be referred to as peripheral conductive housing structures, conductive housing structures, peripheral metal structures, or a peripheral conductive housing member (as examples). Peripheral housing structures 16 may be formed from a metal such as stainless steel, aluminum, or other suitable materials. One, two, or more than two separate structures may be used in forming peripheral housing structures 16.

It is not necessary for peripheral housing structures 16 to have a uniform cross-section. For example, the top portion of peripheral housing structures 16 may, if desired, have an inwardly protruding lip that helps hold display 14 in place. The bottom portion of peripheral housing structures 16 may also have an enlarged lip (e.g., in the plane of the rear surface of device 10). Peripheral housing structures 16 may have substantially straight vertical sidewalls, may have sidewalls that are curved, or may have other suitable shapes. In some configurations (e.g., when peripheral housing structures 16 serve as a bezel for display 14), peripheral housing structures 16 may run around the lip of housing 12 (i.e., peripheral housing structures 16 may cover only the edge of housing 12 that surrounds display 14 and not the rest of the sidewalls of housing 12).

If desired, housing 12 may have a conductive rear surface. For example, housing 12 may be formed from a metal such as stainless steel or aluminum. The rear surface of housing 12 may lie in a plane that is parallel to display 14. In configurations for device 10 in which the rear surface of housing 12 is formed from metal, it may be desirable to form parts of peripheral conductive housing structures 16 as integral portions of the housing structures forming the rear surface of housing 12. For example, a rear housing wall of device 10 may be formed from a planar metal structure and portions of peripheral housing structures 16 on the sides of housing 12 may be formed as flat or curved vertically extending integral metal portions of the planar metal structure. Housing structures such as these may, if desired, be machined from a block of metal and/or may include multiple metal pieces that are assembled together to form housing 12. The planar rear wall of housing 12 may have one or more, two or more, or three or more portions.

Display 14 may have an array of pixels that form an active area AA that displays images for a user of device 10. An inactive border region such as inactive area IA may run along one or more of the peripheral edges of active area AA.

Display 14 may include conductive structures such as an array of capacitive electrodes for a touch sensor, conductive lines for addressing pixels, driver circuits, etc. Housing 12 may include internal conductive structures such as metal frame members and a planar conductive housing member (sometimes referred to as a midplate) that spans the walls of housing 12 (i.e., a substantially rectangular sheet formed from one or more parts that is welded or otherwise connected between opposing sides of member 16). Device 10 may also include conductive structures such as printed circuit boards, components mounted on printed circuit boards, and other internal conductive structures. These conductive structures, which may be used in forming a ground plane in device 10, may be located in the center of housing 12 and may extend under active area AA of display 14.

In regions 22 and 20, openings may be formed within the conductive structures of device 10 (e.g., between peripheral conductive housing structures 16 and opposing conductive ground structures such as conductive housing midplate or rear housing wall structures, a printed circuit board, and conductive electrical components in display 14 and device 10). These openings, which may sometimes be referred to as gaps, may be filled with air, plastic, and other dielectrics and may be used in forming slot antenna resonating elements for one or more antennas in device 10.

Conductive housing structures and other conductive structures in device 10 such as a midplate, traces on a printed circuit board, display 14, and conductive electronic components may serve as a ground plane for the antennas in device 10. The openings in regions 20 and 22 may serve as slots in open or closed slot antennas, may serve as a central dielectric region that is surrounded by a conductive path of materials in a loop antenna, may serve as a space that separates an antenna resonating element such as a strip antenna resonating element or an inverted-F antenna resonating element from the ground plane, may contribute to the performance of a parasitic antenna resonating element, or may otherwise serve as part of antenna structures formed in regions 20 and 22. If desired, the ground plane that is under active area AA of display 14 and/or other metal structures in device 10 may have portions that extend into parts of the ends of device 10 (e.g., the ground may extend towards the dielectric-filled openings in regions 20 and 22), thereby narrowing the slots in regions 20 and 22. In configurations for device 10 with narrow U-shaped openings or other openings that run along the edges of device 10, the ground plane of device 10 can be enlarged to accommodate additional electrical components (integrated circuits, sensors, etc.)

In general, device 10 may include any suitable number of antennas (e.g., one or more, two or more, three or more, four or more, etc.). The antennas in device 10 may be located at opposing first and second ends of an elongated device housing (e.g., at ends 20 and 22 of device 10 of FIG. 1), along one or more edges of a device housing, in the center of a device housing, in other suitable locations, or in one or more of these locations. The arrangement of FIG. 1 is merely illustrative.

Portions of peripheral housing structures 16 may be provided with peripheral gap structures. For example, peripheral conductive housing structures 16 may be provided with one or more gaps such as gaps 18, as shown in FIG. 1. The gaps in peripheral housing structures 16 may be filled with dielectric such as polymer, ceramic, glass, air, other dielectric materials, or combinations of these materials. Gaps 18 may divide peripheral housing structures 16 into one or more peripheral conductive segments. There may be, for example, two peripheral conductive segments in peripheral housing structures 16 (e.g., in an arrangement with two of gaps 18), three peripheral conductive segments (e.g., in an arrangement with three of gaps 18), four peripheral conductive segments (e.g., in an arrangement with four gaps 18, etc.). The segments of peripheral conductive housing structures 16 that are formed in this way may form parts of antennas in device 10.

If desired, openings in housing 12 such as grooves that extend partway or completely through housing 12 may extend across the width of the rear wall of housing 12 and may penetrate through the rear wall of housing 12 to divide the rear wall into different portions. These grooves may also extend into peripheral housing structures 16 and may form antenna slots, gaps 18, and other structures in device 10. Polymer or other dielectric may fill these grooves and other housing openings. In some situations, housing openings that form antenna slots and other structure may be filled with a dielectric such as air.

In a typical scenario, device 10 may have upper and lower antennas (as an example). An upper antenna may, for example, be formed at the upper end of device 10 in region 22. A lower antenna may, for example, be formed at the lower end of device 10 in region 20. The antennas may be used separately to cover identical communications bands, overlapping communications bands, or separate communications bands. The antennas may be used to implement an antenna diversity scheme or a multiple-input-multiple-output (MIMO) antenna scheme.

Antennas in device 10 may be used to support any communications bands of interest. For example, device 10 may include antenna structures for supporting local area network communications, voice and data cellular telephone communications, global positioning system (GPS) communications or other satellite navigation system communications, Bluetooth® communications, etc.

Figure 2:
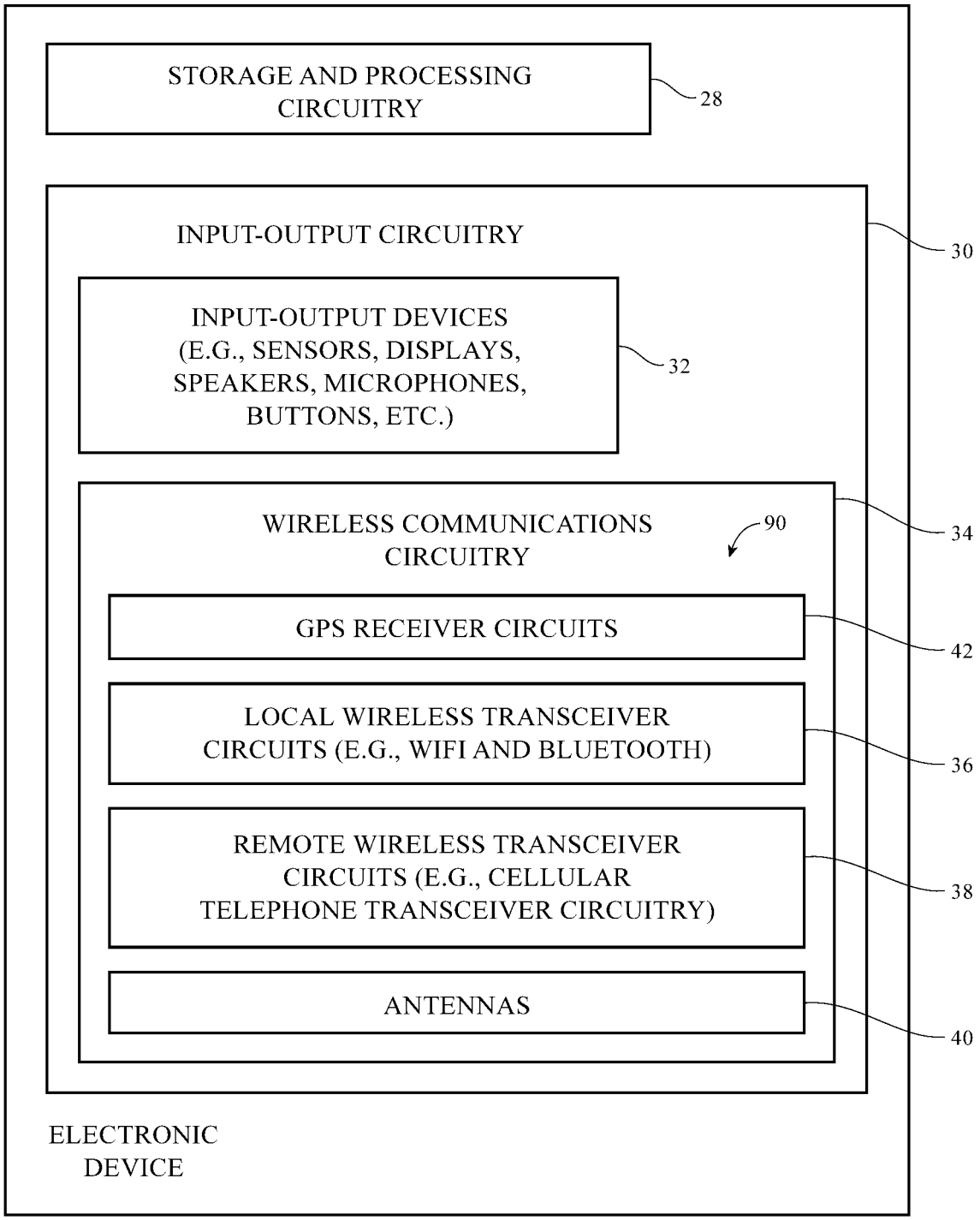
FIG. 2 is a schematic diagram of illustrative circuitry in an electronic device in accordance with an embodiment.

A schematic diagram showing illustrative components that may be used in device 10 of FIG. 1 is shown in FIG. 2. As shown in FIG. 2, device 10 may include control circuitry such as storage and processing circuitry 28. Storage and processing circuitry 28 may include storage such as hard disk drive storage, nonvolatile memory (e.g., flash memory or other electrically-programmable-read-only memory configured to form a solid state drive), volatile memory (e.g., static or dynamic random-access-memory), etc. Processing circuitry in storage and processing circuitry 28 may be used to control the operation of device 10. This processing circuitry may be based on one or more microprocessors, microcontrollers, digital signal processors, application specific integrated circuits, etc.

Storage and processing circuitry 28 may be used to run software on device 10, such as internet browsing applications, voice-over-internet-protocol (VOIP) telephone call applications, email applications, media playback applications, operating system functions, etc. To support interactions with external equipment, storage and processing circuitry 28 may be used in implementing communications protocols. Communications protocols that may be implemented using storage and processing circuitry 28 include internet protocols, wireless local area network protocols (e.g., IEEE 802.11 protocols—sometimes referred to as WiFi®), protocols for other short-range wireless communications links such as the Bluetooth® protocol, cellular telephone protocols, multiple-input and multiple-output (MIMO) protocols, antenna diversity protocols, etc.

Input-output circuitry 30 may include input-output devices 32. Input-output devices 32 may be used to allow data to be supplied to device 10 and to allow data to be provided from device 10 to external devices. Input-output devices 32 may include user interface devices, data port devices, and other input-output components. For example, input-output devices 32 may include touch screens, displays without touch sensor capabilities, buttons, joysticks, scrolling wheels, touch pads, key pads, keyboards, microphones, cameras, buttons, speakers, status indicators, light sources, audio jacks and other audio port components, digital data port devices, light sensors, position and orientation sensors (e.g., sensors such as accelerometers, gyroscopes, and compasses), capacitance sensors, proximity sensors (e.g., capacitive proximity sensors, light-based proximity sensors, etc.), fingerprint sensors (e.g., a fingerprint sensor integrated with a button such as button 24 of FIG. 1 or a fingerprint sensor that takes the place of button 24), etc.

Input-output circuitry 30 may include wireless communications circuitry 34 for communicating wirelessly with external equipment. Wireless communications circuitry 34 may include radio-frequency (RF) transceiver circuitry formed from one or more integrated circuits, power amplifier circuitry, low-noise input amplifiers, passive RF components, one or more antennas, transmission lines, and other circuitry for handling RF wireless signals. Wireless signals can also be sent using light (e.g., using infrared communications).

Wireless communications circuitry 34 may include radio-frequency transceiver circuitry 90 for handling various radio-frequency communications bands. For example, circuitry 34 may include transceiver circuitry 36, 38, and 42. Transceiver circuitry 36 may handle 2.4 GHz and 5 GHz bands for WiFi® (IEEE 802.11) communications and may handle the 2.4 GHz Bluetooth® communications band. Circuitry 34 may use cellular telephone transceiver circuitry 38 for handling wireless communications in frequency ranges such as a low communications band from 700 to 960 MHz, a low-midband from 960-1710 MHz, a midband from 1710 to 2170 MHz, and a high band from 2300 to 2700 MHz or other communications bands between 700 MHz and 2700 MHz or other suitable frequencies (as examples). Circuitry 38 may handle voice data and non-voice data. Wireless communications circuitry 34 can include circuitry for other short-range and long-range wireless links if desired. For example, wireless communications circuitry 34 may include 60 GHz transceiver circuitry, circuitry for receiving television and radio signals, paging system transceivers, near field communications (NFC) circuitry, etc. Wireless communications circuitry 34 may include global positioning system (GPS) receiver equipment such as GPS receiver circuitry 42 for receiving GPS signals at 1575 MHz or for handling other satellite positioning data. In WiFi® and Bluetooth® links and other short-range wireless links, wireless signals are typically used to convey data over tens or hundreds of feet. In cellular telephone links and other long-range links, wireless signals are typically used to convey data over thousands of feet or miles.

Wireless communications circuitry 34 may include antennas 40. Antennas 40 may be formed using any suitable antenna types. For example, antennas 40 may include antennas with resonating elements that are formed from loop antenna structures, patch antenna structures, inverted-F antenna structures, slot antenna structures, planar inverted-F antenna structures, helical antenna structures, hybrids of these designs, etc. Different types of antennas may be used for different bands and combinations of bands. For example, one type of antenna may be used in forming a local wireless link antenna and another type of antenna may be used in forming a remote wireless link antenna.

Figure 3:
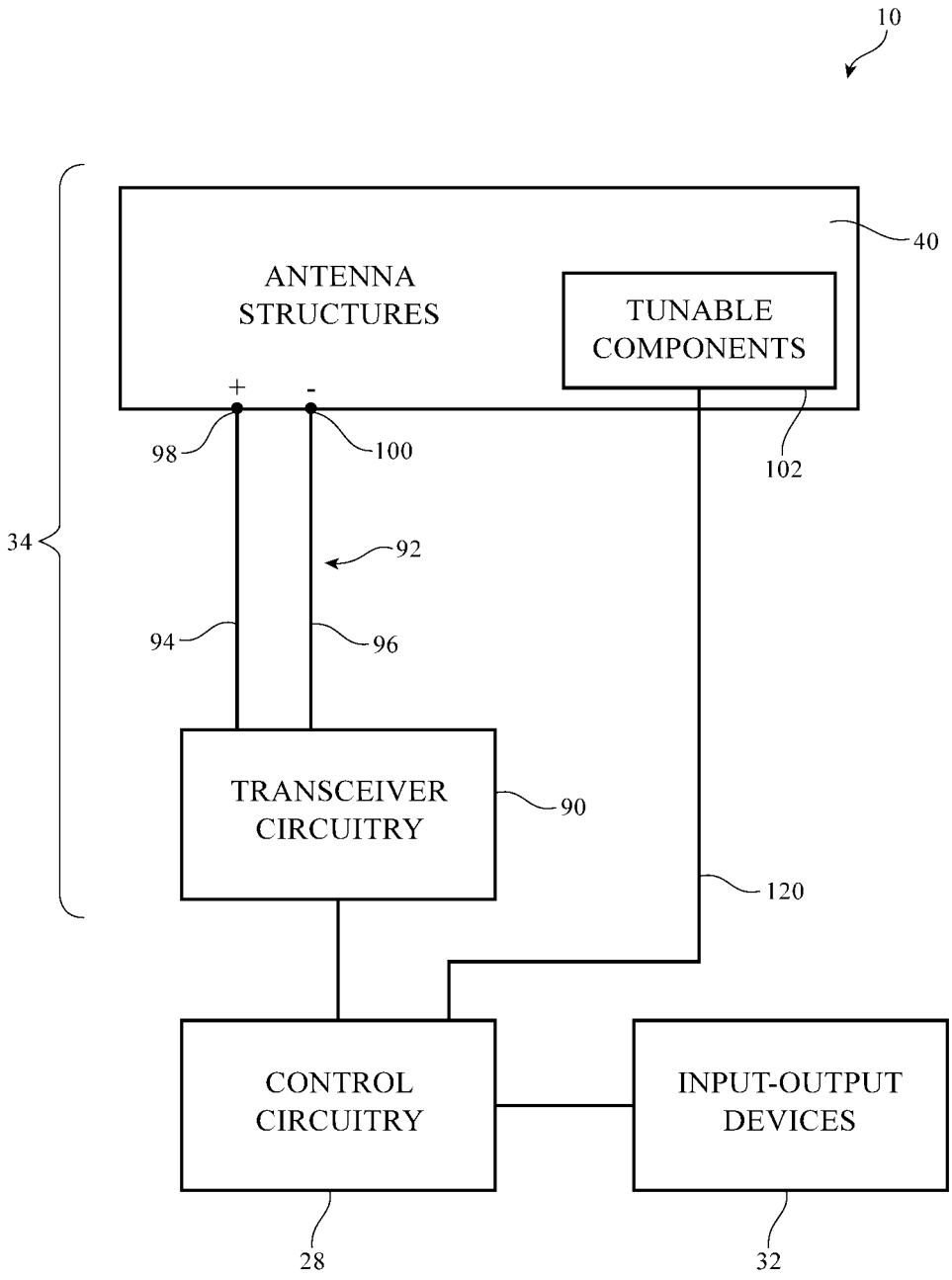
FIG. 3 is a schematic diagram of illustrative wireless circuitry in accordance with an embodiment.

As shown in FIG. 3, transceiver circuitry 90 in wireless circuitry 34 may be coupled to antenna structures 40 using paths such as path 92. Wireless circuitry 34 may be coupled to control circuitry 28. Control circuitry 28 may be coupled to input-output devices 32. Input-output devices 32 may supply output from device 10 and may receive input from sources that are external to device 10.

To provide antenna structures such as antenna(s) 40 with the ability to cover communications frequencies of interest, antenna(s) 40 may be provided with circuitry such as filter circuitry (e.g., one or more passive filters and/or one or more tunable filter circuits). Discrete components such as capacitors, inductors, and resistors may be incorporated into the filter circuitry. Capacitive structures, inductive structures, and resistive structures may also be formed from patterned metal structures (e.g., part of an antenna). If desired, antenna (s) 40 may be provided with adjustable circuits such as tunable components 102 to tune antennas over communications bands of interest. Tunable components 102 may be part of a tunable filter or tunable impedance matching network, may be part of an antenna resonating element, may span a gap between an antenna resonating element and antenna ground, etc. Tunable components 102 may include tunable inductors, tunable capacitors, or other tunable components. Tunable components such as these may be based on switches and networks of fixed components, distributed metal structures that produce associated distributed capacitances and inductances, variable solid state devices for producing variable capacitance and inductance values, tunable filters, or other suitable tunable structures. During operation of device 10, control circuitry 28 may issue control signals on one or more paths such as path 120 that adjust inductance values, capacitance values, or other parameters associated with tunable components 102, thereby tuning antenna structures 40 to cover desired communications bands.

Path 92 may include one or more transmission lines. As an example, signal path 92 of FIG. 3 may be a transmission line having a positive signal conductor such as line 94 and a ground signal conductor such as line 96. Lines 94 and 96 may form parts of a coaxial cable or a microstrip transmission line (as examples). A matching network formed from components such as inductors, resistors, and capacitors may be used in matching the impedance of antenna(s) 40 to the impedance of transmission line 92. Matching network components may be provided as discrete components (e.g., surface mount technology components) or may be formed from housing structures, printed circuit board structures, traces on plastic supports, etc. Components such as these may also be used in forming filter circuitry in antenna(s) 40 and may be tunable and/or fixed components.

Transmission line 92 may be coupled to antenna feed structures associated with antenna structures 40. As an example, antenna structures 40 may form an inverted-F antenna, a slot antenna, a hybrid inverted-F slot antenna or other antenna having an antenna feed with a positive antenna feed terminal such as terminal 98 and a ground antenna feed terminal such as ground antenna feed terminal 100. Positive transmission line conductor 94 may be coupled to positive antenna feed terminal 98 and ground transmission line conductor 96 may be coupled to ground antenna feed terminal 92. Other types of antenna feed arrangements may be used if desired. For example, antenna structures 40 may be fed using multiple feeds. The illustrative feeding configuration of FIG. 3 is merely illustrative.

Control circuitry 28 may use an impedance measurement circuit to gather antenna impedance information. Control circuitry 28 may use information from a proximity sensor (see, e.g., sensors 32 of FIG. 2), received signal strength information, device orientation information from an orientation sensor, information from one or more antenna impedance sensors, or other information in determining when antenna 40 is being affected by the presence of nearby external objects or is otherwise in need of tuning. In response, control circuitry 28 may adjust an adjustable inductor, adjustable capacitor, switch, or other tunable component 102 to ensure that antenna 40 operates as desired. Adjustments to component 102 may also be made to extend the coverage of antenna 40 (e.g., to cover desired communications bands that extend over a range of frequencies larger than antenna 40 would cover without tuning).

Figure 4:
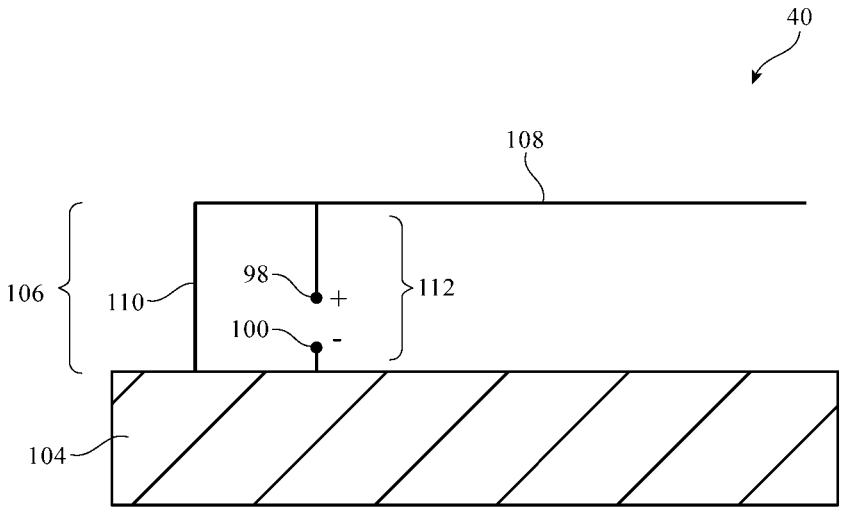
FIG. 4 is a schematic diagram of an illustrative inverted-F antenna in accordance with an embodiment.

FIG. 4 is a diagram of illustrative inverted-F antenna structures that may be used in implementing antenna 40 for device 10. Inverted-F antenna 40 of FIG. 4 has antenna resonating element 106 and antenna ground (ground plane) 104. Antenna resonating element 106 may have a main resonating element arm such as arm 108. The length of arm 108 and/or portions of arm 108 may be selected so that antenna 40 resonates at desired operating frequencies. For example, if the length of arm 108 may be a quarter of a wavelength at a desired operating frequency for antenna 40. Antenna 40 may also exhibit resonances at harmonic frequencies.

Main resonating element arm 108 may be coupled to ground 104 by return path 110. An inductor or other component may be interposed in path 110 and/or tunable components 102 may be interposed in path 110 and/or coupled in parallel with path 110 between arm 108 and ground 104.

Antenna 40 may be fed using one or more antenna feeds. For example, antenna 40 may be fed using antenna feed 112. Antenna feed 112 may include positive antenna feed terminal 98 and ground antenna feed terminal 100 and may run in parallel to return path 110 between arm 108 and ground 104. If desired, inverted-F antennas such as illustrative antenna 40 of FIG. 4 may have more than one resonating arm branch (e.g., to create multiple frequency resonances to support operations in multiple communications bands) or may have other antenna structures (e.g., parasitic antenna resonating elements, tunable components to support antenna tuning, etc.). For example, arm 108 may have left and right branches that extend outwardly from feed 112 and return path 110. Multiple feeds may be used to feed antennas such as antenna 40.

Figure 5:
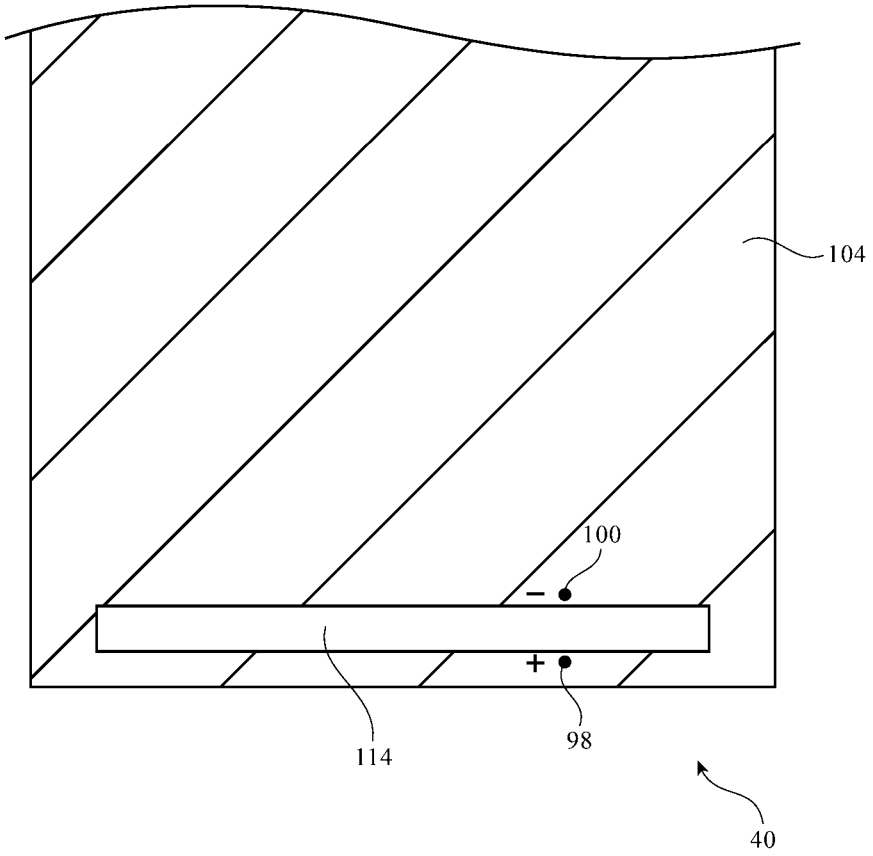
FIG. 5 is a schematic diagram of an illustrative slot antenna in accordance with an embodiment of the present invention.

Antenna 40 may be a hybrid antenna that includes one or more slot antenna resonating elements. As shown in FIG. 5, for example, antenna 40 may be based on a slot antenna configuration having an opening such as slot 114 that is formed within conductive structures such as antenna ground 104. Slot 114 may be filled with air, plastic, and/or other dielectric. The shape of slot 114 may be straight or may have one or more bends (i.e., slot 114 may have an elongated shape following a meandering path). The antenna feed for antenna 40 may include positive antenna feed terminal 98 and ground antenna feed terminal 100. Feed terminals 98 and 100 may, for example, be located on opposing sides of slot 114 (e.g., on opposing long sides). Slot-based antenna resonating elements such as slot antenna resonating element 114 of FIG. 5 may give rise to an antenna resonance at frequencies in which the wavelength of the antenna signals is equal to the perimeter of the slot. In narrow slots, the resonant frequency of a slot antenna resonating element is associated with signal frequencies at which the slot length is equal to a half of a wavelength. Slot antenna frequency response can be tuned using one or more tunable components such as tunable inductors or tunable capacitors. These components may have terminals that are coupled to opposing sides of the slot (i.e., the tunable components may bridge the slot). If desired, tunable components may have terminals that are coupled to respective locations along the length of one of the sides of slot 114. Combinations of these arrangements may also be used.

Figure 6:
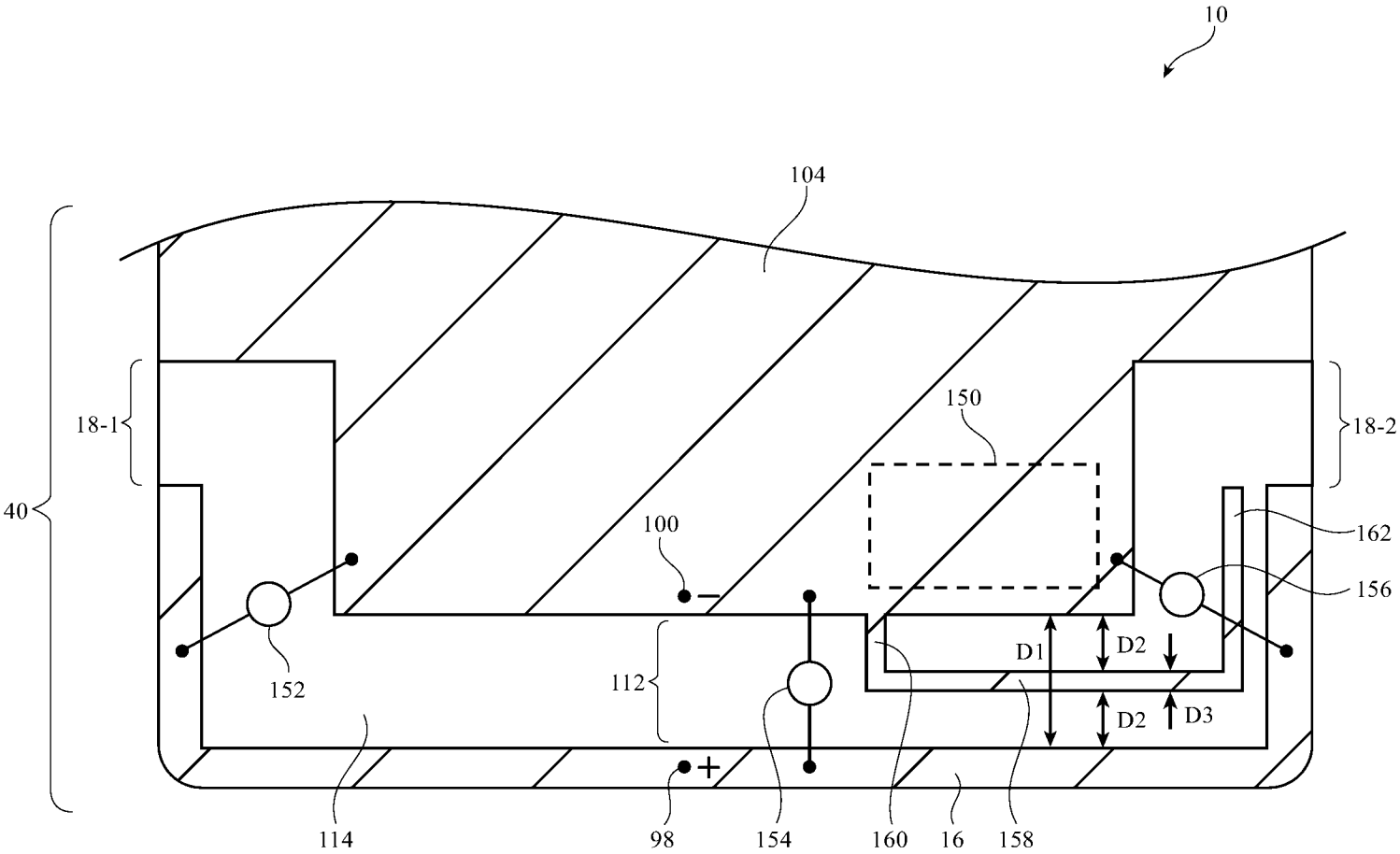
FIGS. 6 and 7 are diagrams of illustrative antenna structures that include a parasitic antenna resonating element arm embedded within an antenna slot in accordance with an embodiment.

Antenna 40 may be a hybrid slot-inverted-F antenna that includes resonating elements of the type shown in both FIG. 4 and FIG. 5. An illustrative configuration for an antenna with slot and inverted-F antenna structures is shown in FIG. 6. As shown in FIG. 6, antenna 40 (e.g., a hybrid slot-inverted-F antenna) may be fed by transceiver circuitry that is coupled to antenna feed 112. One or more additional feeds may be coupled to antenna 40, if desired. Antenna 40 may include a slot such as slot 114 that is formed from an elongated gap between peripheral conductive structures 16 and ground 104 (e.g., a slot formed in housing 12 using machining tools or other equipment). The slot may be filled with dielectrics such as air and/or plastic. For example, plastic may be inserted into the portions of slot 114 that are flush with the outside of housing 12.

Portions of slot 114 may contribute slot antenna resonances to antenna 40. Peripheral conductive structures 16 may form an antenna resonating element arm such as arm 108 of FIG. 4 that extends between gaps 18-1 and 18-2 (e.g., gaps 18 in peripheral conductive structures 16). A return path such as path 110 of FIG. 4 may be formed by a fixed conductive path bridging slot 114 or an adjustable component such as a switch that can be closed to form a short circuit across slot 114.

To enhance frequency coverage for antenna 40, antenna 40 may be provided with a parasitic antenna resonating element such as parasitic antenna resonating element 158. Device 10 may also have one or more supplemental antennas such as antenna 150 to enhance the frequency coverage of antenna 40. Antenna 150 may be fed using a feed that is separate from feed 112.

Optional adjustable components such as components 152, 154, and 156 may be used in adjusting the operation of antenna 40. Components 152, 154, and 156 may include switches, switches coupled to fixed components such as inductors and capacitors and other circuitry for providing adjustable amounts of capacitance, adjustable amounts of inductance, etc. Adjustable components in antenna 40 may be used to tune antenna coverage, may be used to restore antenna performance that has been degraded due to the presence of an external object such as a hand or other body part of a user, and/or may be used to adjust for other operating conditions and to ensure satisfactory operation at desired frequencies.

Parasitic antenna resonating element 158 may have a first end such as end 160 that protrudes into slot 114 from antenna ground 104 at a given location along the length of slot 114 and may have a second end such as end 162 that lies within slot 114. Slot 114 may have an elongated shape (e.g., a slot shape) or other suitable elongated gap shape. In the example of FIG. 6, slot 114 has a U shape that runs along the periphery of device 10 between peripheral conductive structures 16 (e.g., housing sidewalls) and portions of the rear wall of device 10 (e.g., ground 104). In this type of configuration, parasitic antenna resonating element 158 may extend from end 160 to end 162 along the length of slot 114 without touching peripheral conductive structures 16 or ground 104 on the opposing side of slot 114 (i.e., without allowing the edges of element 158 to contact the inner surfaces of the metal housing forming slot 114).

The length of slot 114 may be about 4-20 cm, more than 2 cm, more than 4 cm, more than 8 cm, more than 12 cm, less than 25 cm, less than 15 cm, less than 10 cm, or other suitable length. Element 158 may have a width D3 of about 0.5 mm (e.g., less than 0.8 mm, less than 0.6 mm, more than 0.3 mm, 0.4 to 0.6 mm, etc.) or other suitable width. Slot 114 may have a width of about 2 mm (e.g., less than 4 mm, less than 3 mm, less than 2 mm, more than 1 mm, more than 1.5 mm, 1-3 mm, etc.) or other suitable width. The length of element 158 may be 1-10 cm, more than 2 cm, 2-7 cm, 1-5 cm, less than 10 cm, less than 5 cm, or other suitable length). The portions of slot 114 that separate element 158 from ground 104 and peripheral conductive housing structures 16 may have a width D2 of about 0.75 (e.g., more than 0.4, more than 0.6, less than 0.8, less than 1 mm, 0.3-1.2 mm, etc.).

Element 158 may resonate in a desired communications band and thereby provide enhanced frequency coverage for antenna 40 in the desired communications band (e.g., element 158 may resonant at frequencies in a high communications band at 2300-2700 MHz or other suitable band). Element 158 may be formed from a metal structure on a printed circuit, from a portion of a conductive housing structure, or from other conductive structures in device 10.

In the example of FIG. 6, slot 114 has a U shape. If desired, slot 114 may have other shapes such as the straight slot shape of slot 114 of FIG. 7. In an arrangement of the type shown in FIG. 6, the tip of element 158 may be bent to accommodate a bend of slot 114 at the corner of device 10. In the illustrative arrangement of FIG. 7, element 158 is straight and unbent. In other configurations for antenna 40, slot 114 and element 158 may have different shapes. The arrangements of FIGS. 6 and 7 are illustrative.

Figure 7:
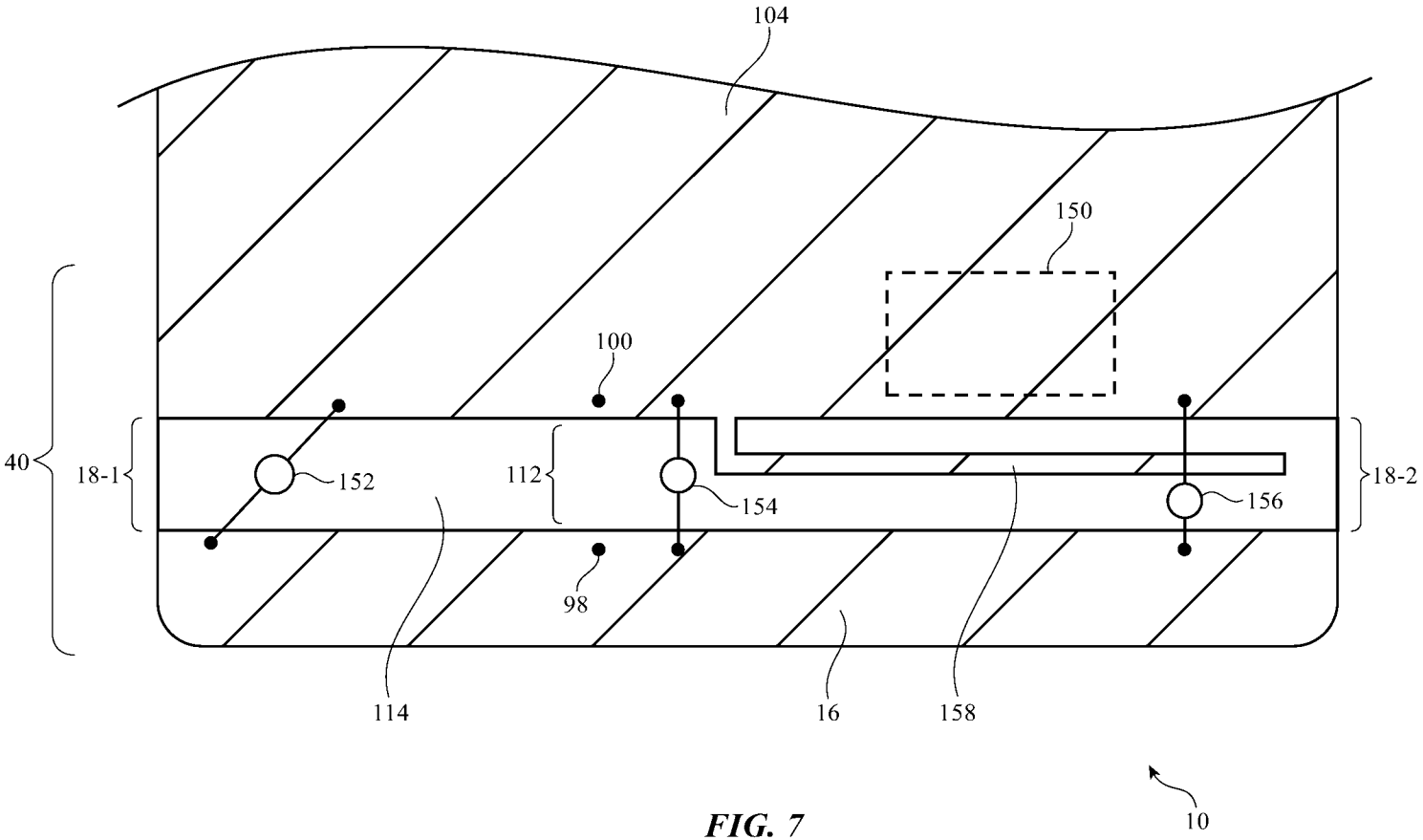
Figure 8:
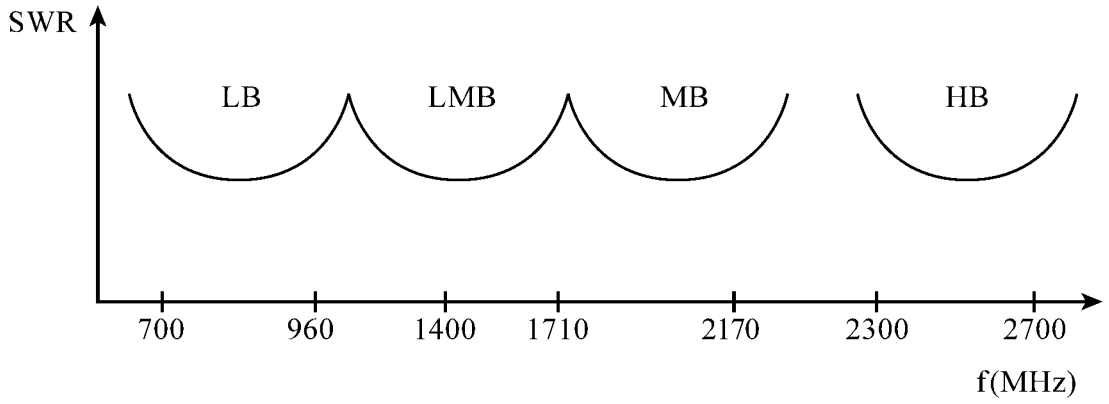
FIG. 8 is a graph in which antenna performance (standing wave ratio) has been plotted as a function of operating frequency in accordance with an embodiment.

FIG. 8 is a graph in which antenna performance (standing-wave ratio SWR) has been plotted as a function of operating frequency f for an illustrative antenna such as antenna 40 of FIGS. 6 and 7 (including parasitic element 158 and supplemental antenna element 150). As shown in FIG. 8, antenna 40 may exhibit resonances in a low band LB, low-middle band LMB, midband MB, and high band HB.

Low band LB may extend from 700 MHz to 960 MHz or other suitable frequency range. Peripheral conductive structures 16 may serve as an inverted-F resonating element arm such as arm 108 of FIG. 4. The resonance of antenna 40 at low band LB may be associated with the distance along peripheral conductive structures 16 between component 152 of FIG. 6 and gap 18-2. Gap 18-2 may be one of gaps 18 in peripheral conductive housing structures 16. FIG. 6 is a rear view of device 10, so gap 18-2 of FIG. 6 lies on the left edge of device 10 when device 10 is viewed from the front. Component 152 may include a switch that can be closed to form a return path for an inverted-F antenna (e.g., an inverted-F antenna that has a resonating element arm formed from structures 16) and/or other return path structures may be formed for antenna 40.

Low midband LMB may extend from 1400 MHz to 1710 MHz or other suitable frequency range. An antenna resonance for supporting communications at frequencies in low midband LMB may be associated with a monopole element or other antenna element such as element 150.

Midband MB may extend from 1710 MHz to 2170 MHz or other suitable frequency range. Antenna 40 may exhibit first and second resonances in midband MB. A first of these midband resonances may be associated with the distance between feed 112 and gap 18-1. A second of these resonances may be associated with the distance between feed 112 and component 152 (e.g., a switch that may be used in forming a return path).

High band HB may extend from 2300 MHz to 2700 MHz or other suitable frequency range. Antenna performance in high band HB may be supported by the resonance of parasitic antenna resonating element 158 (e.g., the length of element 158 may exhibit a quarter wavelength resonance at operating frequencies in band HB).

FIGS. 9, 10, 11, and 12 are rear perspective views of device 10 in illustrative configurations in which parasitic antenna resonating element 158 has been embedded in slot 114.

Figure 9:
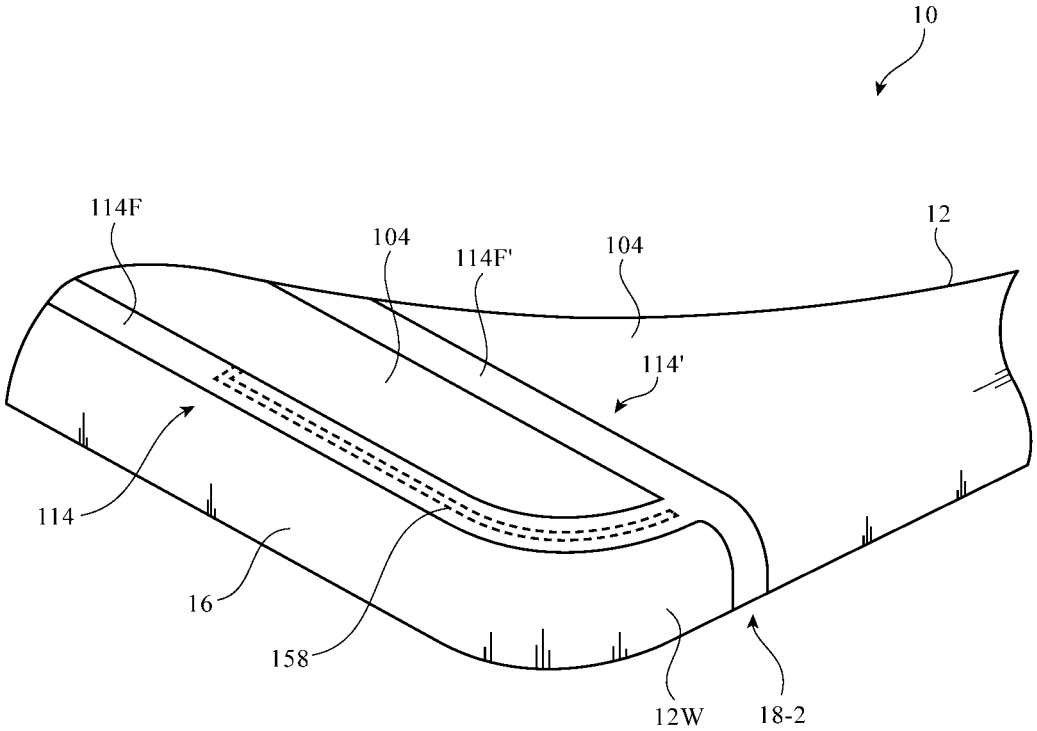
FIGS. 9, 10, 11, and 12 are rear perspective views of illustrative electronic devices having antennas with an embedded parasitic elements in accordance with embodiments.

As shown in FIG. 9, slot 114 may run along the edge of housing 12. Slot 114 may extend entirely through the rear surface of housing 12 and may therefore isolate peripheral conductive structures 16 from ground portion 104 of housing 12. Dielectric filler material such as plastic 114F may fill slot 114. Parasitic antenna resonating element 158 may be embedded within plastic filler 114F in slot 114. During use of device 10, plastic filler 114F may help retain parasitic antenna resonating element 158 at a fixed location relative to adjacent conductive structures such as peripheral conductive housing structures 16 (e.g., wall portions of housing 12) and the rear wall of housing 12 that forms ground 104. An end portion of slot 114 may extend down sidewall 12W of housing 12 to the front face of device 10 (e.g., to a layer of display cover glass covering display 14 on the front of device 10).

In the example of FIG. 9, the rear surface of housing 12 has also been provided with a shallow groove such as groove 114' to form a cosmetic slot. Groove 114' need not extend entirely through housing 12 or may be bridged by internal conductive structures and may therefore not electrically isolate portions of housing 12 from each other. Plastic or other filler material 114F' may be placed within groove 114'.

Figure 10:
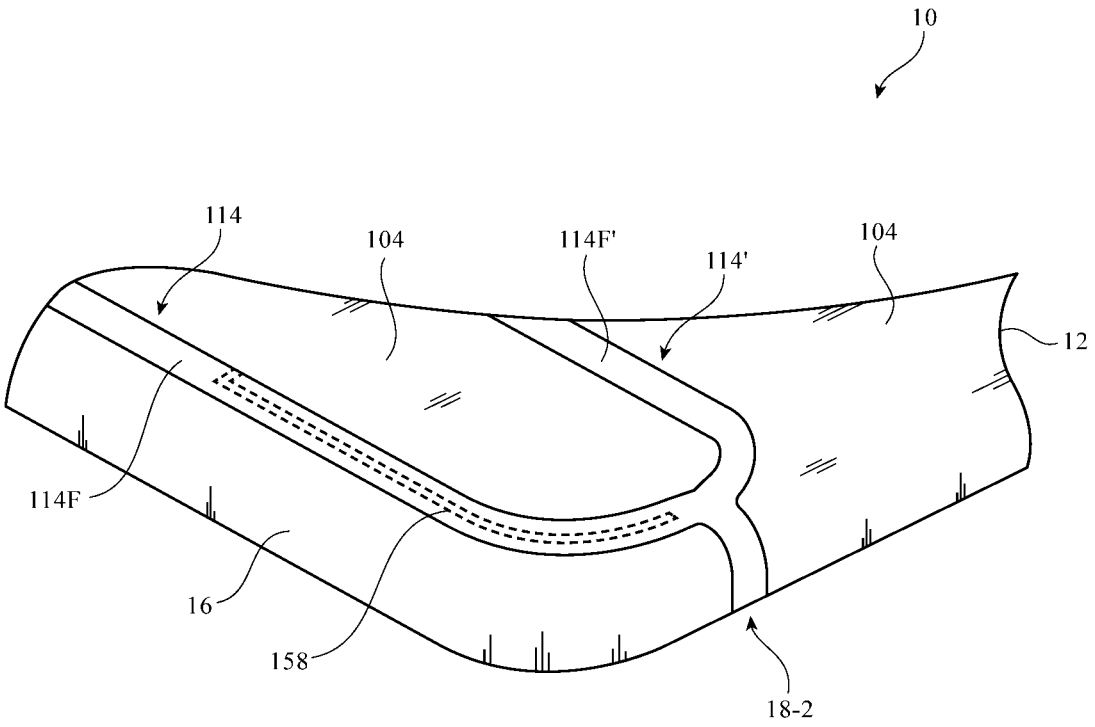

In the configuration of FIG. 9, groove 114' has a straight shape that extends between opposing peripheral conductive housing structure gaps 18-1 and 18-2. In the example of FIG. 10, groove 114' extends between gaps 18-1 and 18-2 on the right and left edges of device 10, respectively, while bending away from slot 114.

Figure 11:
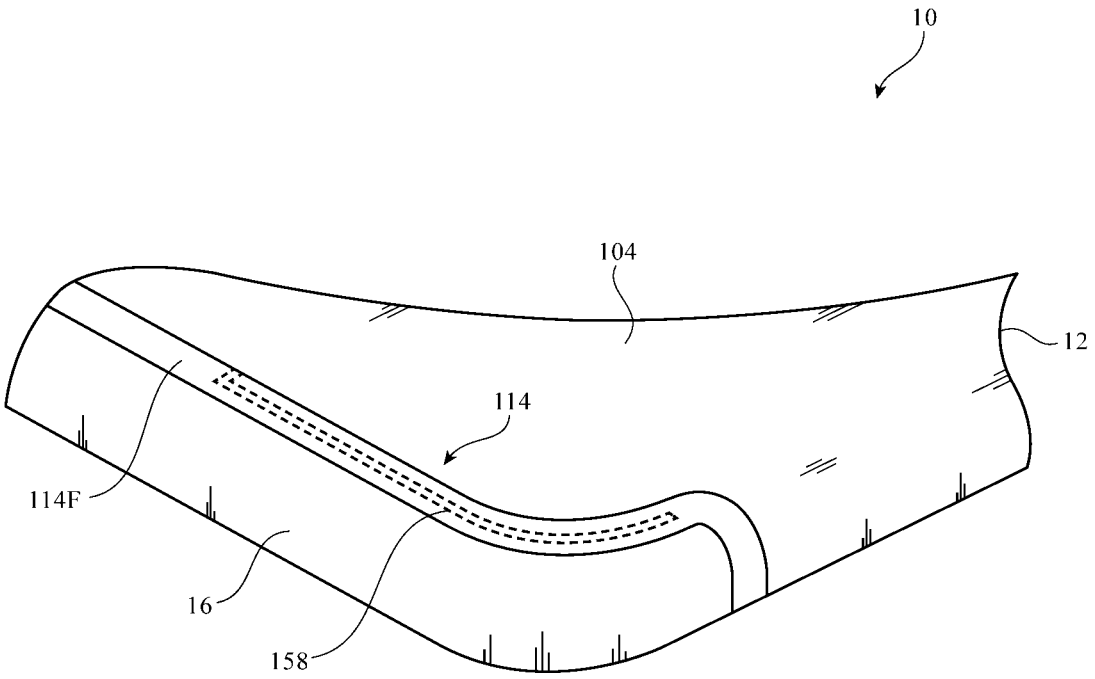
Figure 12:
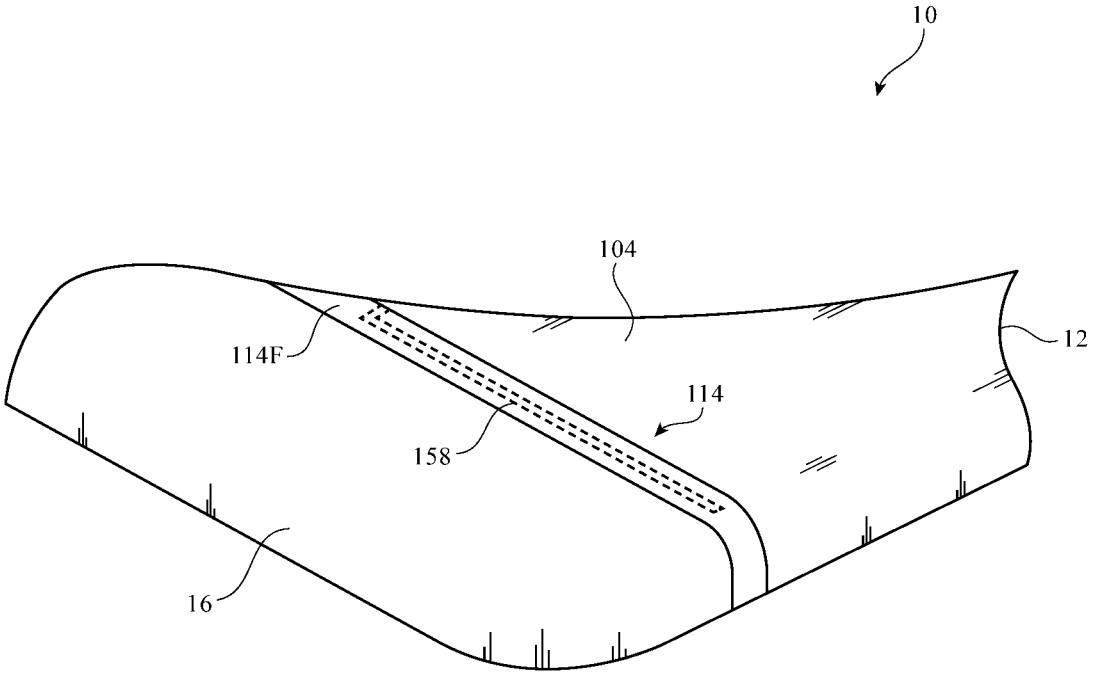

Another illustrative configuration for slot 114 is shown in FIG. 11. In the example of FIG. 11, slot 114 has a straight shape that extends between gaps 18-1 and 18-2 and the cosmetic slot formed from groove 114' has been omitted. FIG. 12 shows how slot 114 may have a curved U shape that follows the lower edge of housing 12 while extending between gaps 18-1 and 18-2. Other configurations may be used for forming slots in device housing 12, if desired. The illustrative configurations of FIGS. 9, 10, 11, and 12 are merely illustrative.

Figure 13:
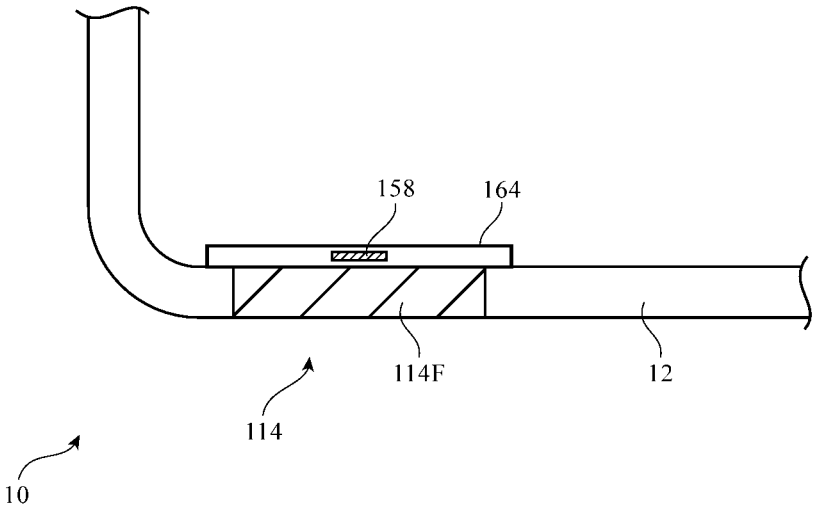
FIG. 13 is a cross-sectional view of a portion of an antenna having a parasitic element formed from a metal trace on a printed circuit in accordance with an embodiment.

FIG. 13 is a cross-sectional side view of a portion of device 10 in the vicinity of slot 114. As shown in FIG. 13, filler material 114F (e.g., plastic or other dielectric) may be placed within slot 114. In the example of FIG. 13, parasitic antenna resonating element 158 has been implemented using a metal trace in printed circuit 164 (e.g., a rigid printed circuit board formed from a rigid printed circuit board material such as fiberglass-filled epoxy or a flexible printed circuit formed from a sheet of polyimide or other flexible polymer). With this type of arrangement, parasitic antenna resonating element 158 may run along the middle of slot 114 equidistant from the sides of slot 114, as shown in FIGS. 6, 7, 9, 10, 11, and 12.

If desired, parasitic antenna resonating element 158 may be formed from a metal structure such as a portion of housing 12 or other metal member that is embedded within the dielectric in slot 114. Illustrative equipment for forming a device such as device 10 having an antenna with a parasitic antenna resonating element such as element 158 embedded within a housing slot is shown in FIG. 14.

Figure 14:
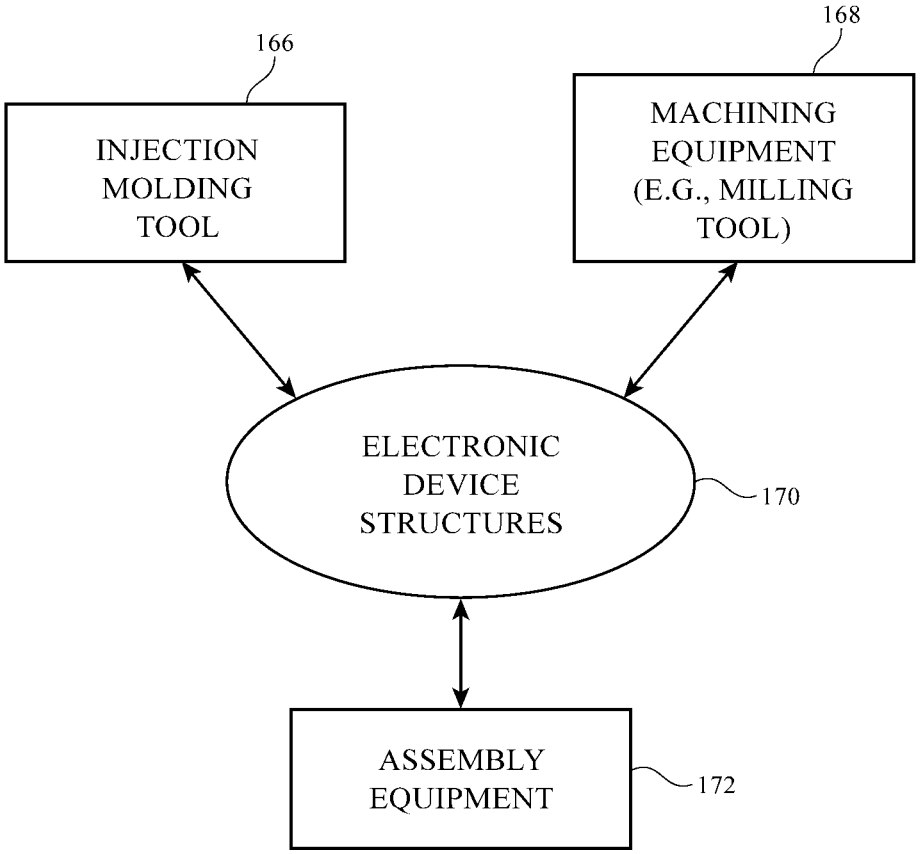
FIG. 14 is a diagram of equipment of the type that may be used in processing antenna structures and assembling electronic devices in accordance with an embodiment.

As shown in FIG. 14, electronic device structures 170 (e.g., parts of device 10 such as structures for forming antenna 40 and other structures) may be fabricated using injection molding equipment such as injection molding tool 166. Injection molding tools such as tool 166 may be used to apply one or more shots of molten plastic to slots and other features in housing 12 and other structures in device 10. Molding tool 166 may have a die with a cavity that allows heated liquid plastic to flow into slots such as slot 114, other grooves or slots (e.g., cosmetic slots formed from grooves that do not penetrate entirely through housing 12 such as grooves 114'), and other features in housing 12 and other portions of device 10. Following cooling, the liquid plastic may solidify to form filler material such as filler 114F and 114F'. Other types of arrangements may be used for incorporating dielectric into slots and grooves in housing 12 if desired. The use of an injection molding tool to mold molten plastic into slot 114 and groove 114' is merely illustrative.

Structures 170 may also be processed using machining equipment 168. Machining equipment 168 may include a computer-controlled milling tool, drill press, or other equipment with moving bits to remove metal, dielectric, and/or other material from structures 170. Laser drilling and other techniques for shaping structures 170 may also be used. The use of milling equipment to process structures 170 is merely illustrative.

In addition to being processed using machining equipment 168 and molding equipment 166, structures 170 may be processed using additional processing and assembly equipment such as equipment 172. Equipment 172 may include robotic equipment for assembling components together for device 10 and for combining assemblies together to form a finished device. Equipment 172 may include equipment for attaching radio-frequency transceiver circuitry, radio-frequency transmission lines, and other circuitry to printed circuits, for coupling transmission lines and other structures to housing structures and/or antenna structures, equipment for joining structures with fasteners, adhesive, and other attachment mechanisms, and other equipment for assembling the part of device 10 together.

An illustrative process for forming an antenna such as antenna 40 having a slot with an embedded parasitic antenna resonating element is shown in FIGS. 15, 16, 17, and 18. FIGS. 15, 16, 17, and 18 are cross-sectional side views of the lower edge of housing 12 showing how antenna 40 may be formed using injection molding tool 166 and machining equipment 168. Housing 12 may be formed from aluminum, stainless steel, or other metals (as an example).

Figure 15:
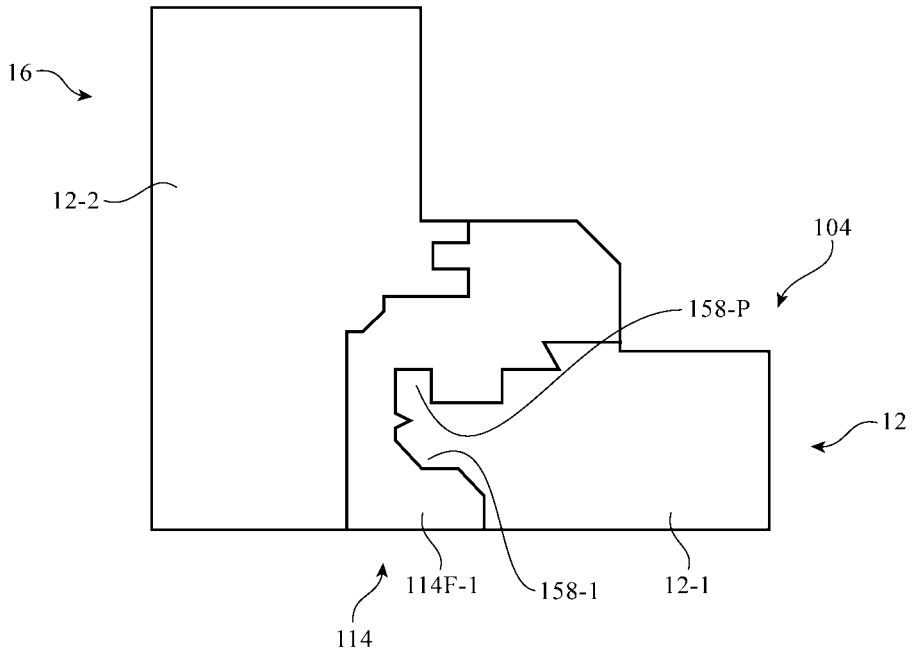
FIG. 15 is a cross-sectional side view of metal housing structures into which a slot has been milled and a first shot of plastic has been molded in accordance with an embodiment.

Initially, housing portion 12-1 (e.g., a sidewall portion) and housing portion 12-2 (e.g., a rear housing wall) are separated from each other by machining a slot (e.g., a slot equal in width to the final version of slot 114 or slightly narrow than the final version of slot 114) into housing 12, as shown in FIG. 15. A first shot of plastic filler such as filler 114F-1 may be injection molded into slot 114 using tool 166 after slot 114 has been formed using machining equipment 168. When milling housing 12 with the first milling operation to form slot 114, engagement features such as recesses and protrusions may be incorporated into the walls of slot 114 to help retain plastic filler 114F-1. Some of housing 12 such as housing portion 158P may protrude into slot 114 and may later be used in forming parasitic antenna resonating element 158. Housing portion 158P may be supported by supporting housing portion 158-1 during the process of injection molding filler 114F into slot 114.

Figure 16:
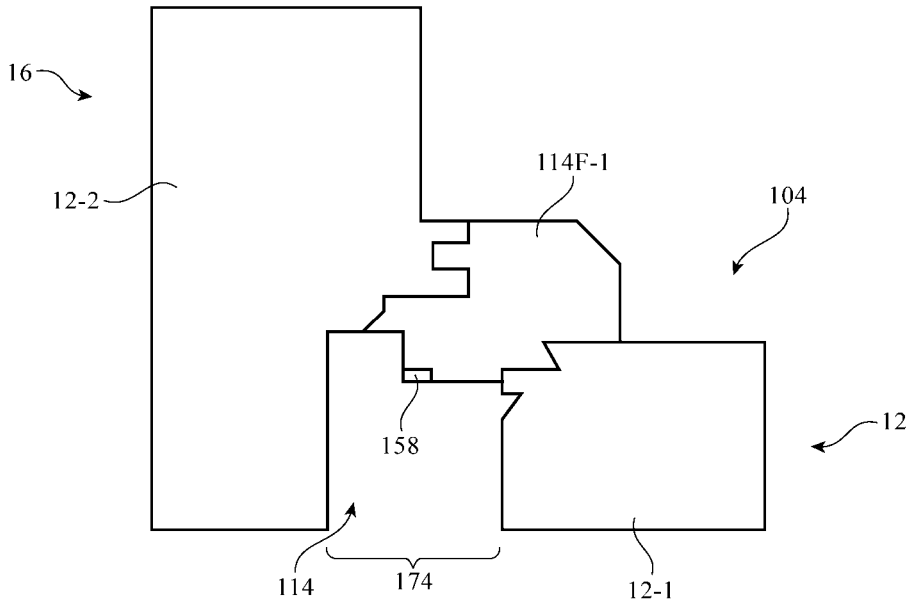
FIG. 16 is a cross-sectional side view of the metal housing structures of FIG. 15 following removal of some of the first shot of plastic and some of the metal housing structure during a milling operation in accordance with an embodiment.

As show in FIG. 16, the structures of FIG. 15 may be milled using a second milling operation that forms a groove along the outer surface of slot 114 (and that may widen slot 114, if desire). The second milling operation may remove the outermost portion of filler 114F-1. The second milling operation may also remove supporting portion 158-1, thereby freeing the protruding portion of housing 12 (protruding portion 158P of FIG. 15) from housing 12 along its length except at end 160, as shown in FIG. 6. This forms parasitic antenna resonating element 158. The portion of filler 114F-1 that remains in the inner portion of slot 114 may support parasitic antenna resonating element 158 so that element 158 does not shift with respect to housing 12 during milling. As a result, the metal of element 158 remains accurately located between the opposing inner surfaces of slot 114 even though element 158 is no longer is connected to housing 12 along its length by supporting portion 158-1 of FIG. 15. The milling process of FIG. 16 leaves an elongated groove such as groove portion 174 of slot 114 that runs along the edge of device 10 between peripheral conductive housing structures 16 and opposing portions of housing 12 forming ground 104. Groove 174 may include engagement features such as notches and/or protrusions to engage injection molded plastic.

Figure 17:
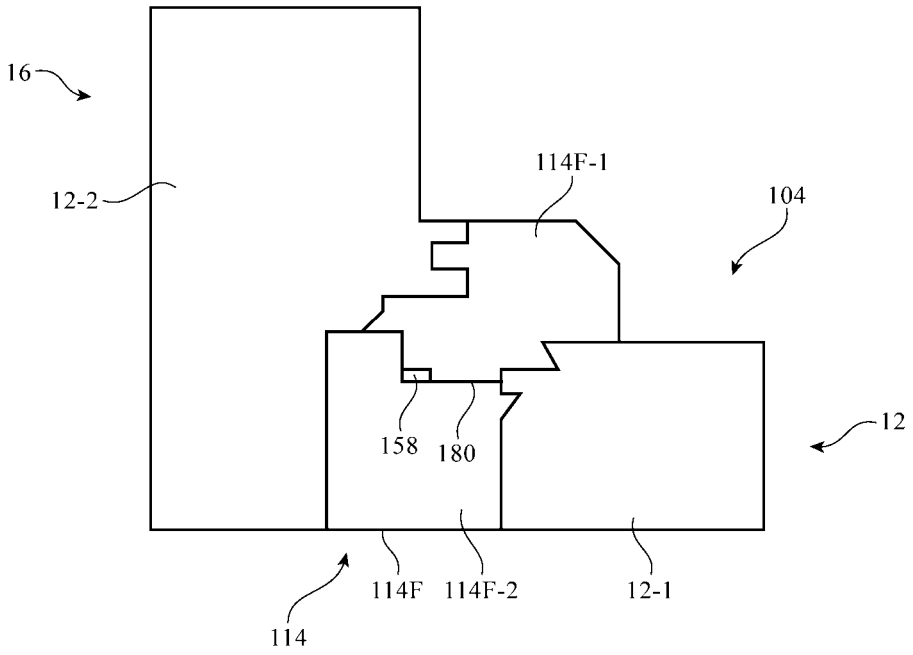
FIG. 17 is a cross-sectional side view of the metal housing structures of FIG. 16 following the addition of a second shot of plastic in accordance with an embodiment.

As shown in FIG. 17, after forming groove 174 and thereby freeing the edge of parasitic antenna resonating element 158 from housing 12, injection molding tool 166 may be used to injection mold a second shot of plastic into slot 114. The second shot of plastic may form outer plastic filler layer 114F-2 of FIG. 17. The plastic that forms outer filler 114F-2 may be of the same type that forms inner filler 114F-1 or may be a different type of plastic. For example, plastics 114F-1 and 114F-2 may have different hardness, different colors, and other material properties that are different from each other. Retention features in groove 174 may help retain second plastic filler layer 114F-2.

Figure 18:
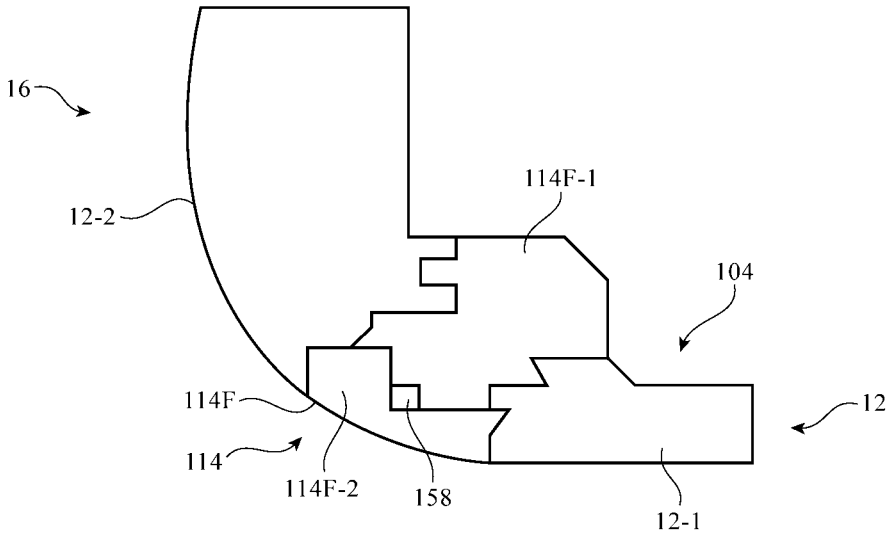
FIG. 18 is a cross-sectional side view of the metal housing structures of FIG. 17 following a milling operation to form a curved outer sidewall surface on the housing structures in accordance with an embodiment.

Following the formation of outer filler layer 114F-2 on top of inner filler layer 114F-1 to form filler 114F in slot 114, the housing of device 10 may be machined again using tool 168 to form a curved sidewall shape or other desired exterior shape for the edge of housing 12 (e.g., peripheral conductive structures 16), as shown in FIG. 18. Parasitic antenna resonating element 158 may remain suspended and supported by surrounding dielectric structures such as filler 114F (except at end 160 of FIG. 6 where element protrudes from housing 12 into slot 114) during the process of machining the exterior of housing 12 to a desired edge profile, so that the edges of element 158 may be maintained at a desired distance from the inner metal surfaces of slot 114. There is an interface (interface 180) between filler 114F-1 and filler 114F-2 and parasitic antenna resonating element 158 lies on this interface.

Element 158 in the example of FIGS. 15, 16, 17, and 18 is an integral portion of housing 12 and has been machined from housing 12 by running milling bits or other milling tools along the edges of element 158 while supporting element 158 by injection molded plastic. If desired, element 158 may be formed from a separate piece of metal (e.g., an elongated metal member) that is suspended within slot 114 using a shot of plastic such as shot 114F-1. In this type of scenario, end 160 of element 158 may be shorted to housing 12-1 using solder, welds, wire, a strip of metal, printed circuit traces, or other conductive structures.

The foregoing is merely illustrative and various modifications can be made by those skilled in the art without departing from the scope and spirit of the described embodiments. The foregoing embodiments may be implemented individually or in any combination.

What is claimed is:

1. An electronic device comprising:

a display having pixel circuitry and a display cover layer;

a housing having a rear wall that opposes the display cover layer and a peripheral conductive sidewall that extends between the rear wall and the display cover layer, wherein the rear wall forms a first exterior surface of the electronic device and the peripheral conductive sidewall forms a second exterior surface of the electronic device;

an antenna having a resonating element arm formed from the peripheral conductive sidewall and an antenna ground that is separated from the peripheral conductive sidewall by a slot that runs along an edge of the housing; and dielectric filler in the slot, wherein the dielectric filler has a curved surface that lies flush with the first and second exterior surfaces of the electronic device, and the curved surface of the dielectric filler forms a third exterior surface of the electronic device.

2. The electronic device defined in claim 1, wherein the second exterior surface of the electronic device is curved.

3. The electronic device defined in claim 2, wherein the first exterior surface of the electronic device is planar.

4. The electronic device defined in claim 3, wherein the second exterior surface is continuously curved from the curved surface of the dielectric filler to the display cover layer.

5. The electronic device defined in claim 4, wherein the antenna comprises a parasitic antenna resonating element formed from a metal arm that extends into the slot.

6. The electronic device defined in claim 3, wherein the rear wall comprises a metal rear wall that forms a part of the antenna ground.

7. The electronic device defined in claim 1, wherein the antenna comprises a parasitic antenna resonating element formed from a metal arm that extends into the slot.

8. The electronic device defined in claim 7, wherein the metal arm is embedded in the dielectric filler.

9. The electronic device defined in claim 1, wherein the dielectric filler comprises first and second shots of molded plastic, the antenna further comprising a metal arm that lies at an interface between the first and second shots of molded plastic.

10. The electronic device defined in claim 1, further comprising:

a gap in the peripheral conductive sidewall that extends from the second exterior surface to the display cover layer.

11. The electronic device defined in claim 10, wherein the dielectric filler comprises a portion formed in the gap in the peripheral conductive sidewall.

12. The electronic device defined in claim 11, wherein the dielectric filler extends continuously from the slot into the gap in the peripheral conductive sidewall.

13. The electronic device defined in claim 1, wherein the peripheral conductive sidewall comprises a dielectric-filled gap that divides the peripheral conductive sidewall, the dielectric filler having an end that fills the dielectric-filled gap.

14. The electronic device defined in claim 13, wherein the slot has a first segment and a second segment that couples the first segment to the dielectric-filled gap, the second segment extending perpendicular to the first segment.

15. The electronic device defined in claim 14, wherein the electronic device has a length, a width that is less than the length, and a height that is less than the width, the peripheral conductive sidewall extends across the height, and the dielectric-filled gap extends across the height.

16. The electronic device defined in claim 15, wherein the antenna has a positive antenna feed terminal coupled to the resonating element arm and a ground antenna feed terminal coupled to the antenna ground.

17. The electronic device defined in claim 1, wherein the antenna comprises a parasitic antenna resonating element formed from a metal arm that overlaps the slot, the electronic device further comprises a printed circuit on the dielectric filler, and the parasitic antenna resonating element arm comprises a metal trace on the printed circuit.

18. An electronic device having first and second faces, comprising:

a display having pixel circuitry and a display cover layer, wherein the display cover layer forms the first face of the electronic device;

a housing having a planar rear wall that forms at least part of the second face of the electronic device and having a curved conductive sidewall that extends between the planar rear wall and the display cover layer;

an antenna having a resonating element arm formed from the curved conductive sidewall and an antenna ground that is separated from the curved conductive sidewall by a slot running along an edge of the housing; and dielectric in the slot, wherein the dielectric has a curved surface that extends from a surface of the curved conductive sidewall to a surface of the planar rear wall, the curved surface being curved continuously from the surface of the curved conductive sidewall to the surface of the planar rear wall.

19. The electronic device defined in claim 18, wherein the antenna further comprises a parasitic antenna resonating element arm on the dielectric that extends into the slot.

20. The electronic device of claim 19, wherein the curved conductive sidewall comprises a dielectric-filled gap that divides the curved conductive sidewall, the dielectric has an end that fills the dielectric-filled gap, the slot has a first segment and a second segment that couples the first segment to the dielectric-filled gap, the second segment extends perpendicular to the first segment, the electronic device has a length, a width that is less than the length, and a height that is less than the width, the curved conductive sidewall extends across the height and is curved along the height, the dielectric-filled gap extends across the height, and the antenna has a positive antenna feed terminal coupled to the resonating element arm and a ground antenna feed terminal coupled to the antenna ground.

21. An electronic device comprising:

a display having pixel circuitry and a display cover layer;

a housing having a rear wall that opposes the display cover layer and a peripheral conductive sidewall that extends between the rear wall and the display cover layer, wherein the rear wall forms a first exterior surface of the electronic device and the peripheral conductive sidewall forms a second exterior surface of the electronic device;

an antenna having a resonating element arm formed from the peripheral conductive sidewall and an antenna ground that is separated from the peripheral conductive sidewall by a slot that runs along an edge of the housing; and dielectric filler in the slot, wherein the dielectric filler has a curved surface that lies flush with the first and second exterior surfaces of the electronic device, the curved surface of the dielectric filler forms a third exterior surface of the electronic device, the electronic device has an interior, the dielectric filler has first and second surfaces that are different from the third exterior surface and that each extend from the third exterior surface towards the interior, the peripheral conductive sidewall has a third surface that is different from the second exterior surface and that extends from the second exterior surface towards the interior, the rear wall has a fourth surface that is different from the first exterior surface and that extends from the first exterior surface towards the interior, the first surface of the dielectric filler directly contacts the third surface of the peripheral conductive sidewall, the second surface of the dielectric filler directly contacts the fourth surface of the rear wall, and the second exterior surface of the peripheral conductive sidewall is at least partially curved.

22. The electronic device defined in claim 21, wherein the second exterior surface of the peripheral conductive sidewall is curved continuously from the third exterior surface of the dielectric filler to the display cover layer, the third exterior surface of the dielectric filler is curved continuously from the second exterior surface of the peripheral conductive sidewall to the first exterior surface of the rear wall, and the first exterior surface of the rear wall is planar.

* * * * *